US006698265B1

(12) United States Patent
Thomas

(10) Patent No.: US 6,698,265 B1
(45) Date of Patent: Mar. 2, 2004

(54) METHOD FOR CLOSELY COUPLING MACHINES USED FOR CAN MAKING

(75) Inventor: Keith A. Thomas, Hammond, IN (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 10/236,521

(22) Filed: Sep. 6, 2002

(51) Int. Cl.[7] ..... B21B 45/02; B21J 11/00
(52) U.S. Cl. ..... 72/94; 72/405.03
(58) Field of Search ..... 72/94, 379.4, 405.03; 198/575, 576, 583, 584, 594

(56) References Cited

U.S. PATENT DOCUMENTS

| | | | | | |
|---|---|---|---|---|---|
| 4,519,232 | A | | 5/1985 | Traczyk et al. | 72/133 |
| 4,774,839 | A | | 10/1988 | Caleffi et al. | 72/354 |
| 5,611,231 | A | * | 3/1997 | Marritt et al. | 72/94 |
| 5,724,848 | A | | 3/1998 | Aschberger | 42/356 |
| 5,755,130 | A | | 5/1998 | Tung et al. | 72/60 |
| 5,768,931 | A | * | 6/1998 | Gombas | 72/184 |
| 5,813,267 | A | | 9/1998 | Aschberger et al. | 72/125 |
| 6,085,563 | A | | 7/2000 | Heiberger et al. | 72/94 |
| 6,094,961 | A | | 8/2000 | Aschberger | 72/352 |
| 6,178,797 | B1 | * | 1/2001 | Marshall et al. | 72/94 |
| 6,240,760 | B1 | * | 6/2001 | Heiberger et al. | 72/94 |
| 6,257,544 | B1 | * | 7/2001 | Schultz | 248/678 |

* cited by examiner

*Primary Examiner*—Ed Tolan
(74) *Attorney, Agent, or Firm*—Woodcock Washburn LLP

(57) ABSTRACT

A preferred method for closely coupling a first and a second necking machine comprises removing an input module from the second necking machine, removing end portions of a bearing support plate and a base of the second necking machine, and fixing a cover plate to the base of the second necking machine. The presently-preferred method also comprises positioning the first and second necking machines end to end so that a drive gear of the discharge module of the first necking machine meshes with a drive gear of the necking module of the second necking machine, and the necking module of the second necking machine is adapted to receive the can body from the discharge module of the first necking machine.

34 Claims, 5 Drawing Sheets

+Z
-Z
+X
-X
3
2
4
5'
5"
7'
7"
9'
9"
9a"
11'
11" (Removed)
12'
12"
16A"
17A'
17A"
17B'
17B"
17C'
17C"
17D'
17D"
17E'
17E"
19A'
19A"
19B'
19B"
19C'
19C"
19D'
19D"
20'
20"
21'
21"
22' (Removed)
22"
51
52
53
5b"
5C

METHOD FOR CLOSELY COUPLING MACHINES USED FOR CAN MAKING

FIELD OF THE INVENTION

The present invention relates to machinery for manufacturing containers. More specifically, the invention relates to a method for closely coupling machines used to neck metallic can bodies.

BACKGROUND OF THE INVENTION

Beverages such as beer and carbonated soft drinks are commonly packaged in two-piece cans formed from aluminum material. Two-piece cans are typically manufactured by attaching a circular lid to an open end of a generally cylindrical can body formed by a drawing and ironing process.

The diameter of the open end of the can body may be reduced prior to attaching the lid thereto. Reducing the diameter of the open end facilitates the use of a smaller-diameter lid than would otherwise be possible. The process by which the diameter of the can end is reduced is known as "necking."

Necking is typically performed in a number of incremental steps, with the diameter of the can end being reduced only slightly in each step. Necking the can end in this manner reduces the potential for the can end to become wrinkled or otherwise distorted as its diameter is reduced.

Necking can be performed in several different manners. For example, a process known as "die necking" is disclosed in U.S. Pat. No. 5,755,130 (Tung et al.), U.S. Pat. No. 4,519,232 (Traczyk et al.) and U.S. Pat. No. 4,774,839 (Caleffi et al.), each of which is incorporated by reference herein in its entirety. Die necking involves forcing an open end of a can body into a die so that an inwardly tapered surface of the die permanently deforms the open end inward. Another type of necking operation is known as "spin necking." Spin necking involves reducing the diameter of a can end by pressing the can end against a rotating tool.

A variety of machines have been developed for necking can ends. For example, FIGS. 1–3 depict a five-stage necking machine 12 adapted to perform a die necking process on a can body 2. (The can body 2 is depicted as entering the necking machine 12 in FIG. 1, with the direction of travel of the can body 2 denoted by the arrow 4).

Necking machines such as the necking machine 12 are available from Belvac Production Machinery of Lynchburg, Va., as model 595 6N/8. A necking machine substantially similar to the necking machine 12 is described in detail in U.S. Pat. No. 6,085,563 (Heiberger et al.), which is incorporated by reference herein in its entirety.

The necking machine 12 comprises a unitary base 5, and a bearing plate 9 fixedly coupled to a top surface of the base 5. The base 5 forms an enclosure adapted to contain a vacuum generated by an external source (not pictured). In other words, the base 5 has a sealed internal volume 35 adapted to contain an externally-generated vacuum (see FIG. 2). (In other words, the internal volume 35 of the necking machine 12 functions as a vacuum chamber.)

Three pipes 58 extend into and out of the base 5 by way of through holes formed in end plates 5a of the base 5 (see FIG. 3). The uppermost pipe 58 conveys vacuum, and the remaining pipes 58 convey positive or pressurized air to the necking machine 12.

The necking machine 12 further comprises an input chute 7 and an input module 11. The input module 11 comprises a feed wheel 6 having a plurality of pockets 25 formed therein (see FIG. 1). The pockets 25 are each adapted to receive the can body 2 from the input chute 7. The feed wheel 6 rotates in a counterclockwise direction (from the perspective of FIG. 1).

The can body 2 is retained in one of the pockets 25 by a vacuum force. More particularly, a port is defined in the surface that defines each of the respective pockets 25. The port communicates fluidly with the internal volume 35, of the base 5 by way of a hose 48 coupled to the internal volume 35 and a rotary manifold (not shown) within the feeder wheel 6. The vacuum is transmitted to the port by the hose 48 and the rotary manifold, and generates a suction force that retains the can body 2 in the pocket 25.

The necking machine 12 further comprises a first, second, third, fourth, and fifth necking module, respectively designated 17*a*, 17*b*, 17*c*, 17*d*, 17*e*. The necking modules 17*a*, 17*b*, 17*c*, 17*d*, 17*e* each comprise a necking station, respectively designated 16*a*, 16*b*, 16*c*, 16*d*, 16*e* (see FIG. 1). The necking stations 16*a*, 16*b*, 16*c*, 16*d*, 16*e* are adapted to incrementally reduce the diameter of an end of the can body 2, as explained below. Each of the necking stations 16*a*, 16*b*, 16*c*, 16*d*, 16*e* rotates in a clockwise direction (from the perspective of FIG. 1).

The necking stations 16*a*, 16*b*, 16*c*, 16*d*, 16*e* each have a plurality of pockets 27 formed therein. The pockets 27 are adapted to receive the can body 2. The can body 2 is retained in the pockets 27 by mechanical guides (not shown), and by the necking process that is performed by the necking stations 16*a*, 16*b*, 16*c*, 16*d*, 16*e*.

The feed wheel 6 carries the can body 2 through an arc of approximately 210 degrees, and deposits the can body 2 into one of the pockets 27 of the necking station 16*a*. Using techniques well known in the art of can making, an open end of the can body 2 is brought into contact with a die (not shown) in the necking station 16*a*. The necking station 16*a* carries the can body 2 through an arc of approximately 180 degrees, along the top portion of the necking station 16*a*. The noted contact between the can body 2 and the die slightly reduces the diameter of the open end of the can body 2. (The diameter -reduction process, as noted above, is commonly referred to as "necking.")

The necking machine 12 also comprises first, second, third, and fourth intermediate, or transfer, modules, respectively designated 19*a*, 19*b*, 19*c*, 19*d*. The transfer modules 19*a*, 19*b*, 19*c*, 19*d* each comprise an intermediate, or transfer, wheel, respectively designated 18*a*, 18*b*, 18*c*, 18*d* (see FIG. 1). The transfer wheels 18*a*, 18*b*, 18*c*, 18*d* each rotate in a counterclockwise direction.

Each of the transfer wheels 18*a*, 18*b*, 18*c*, 18*d* has a plurality of pockets 29 formed therein. The pockets 29 are adapted to receive the can body 2. The can body 2 is retained in the pockets 29 in a manner substantially identical to that described above with respect to the input module 11 and the pockets 25.

The transfer modules 19*a*, 19*b*, 19*c*, 19*d* are each located between a respective pair of the necking modules 17*a*, 17*b*, 17*c*, 17*d*, 17*e*, as depicted in FIGS. 1 and 2. The necking station 16*a* deposits the can body 2 into one of the pockets 29 of the transfer wheel 18*a* after the necking station 16*a* has reduced the diameter of the end of the can body 2 as described above.

The transfer wheel 18*a* carries the can body 2 through an arc of approximately 180 degrees, and deposits the can body 2 into one of the pockets 27 of the necking module 16*b*. The necking module 16*b* further reduces the diameter of the end of the can body 2 in a manner substantially identical to that noted above with respect to the necking station 16*a*.

The can body 2 is subsequently transferred between the necking stations 16*c*, 16*d*, 16*e* by the transfer wheels 18*b*, 18*c*, 18*d*, in a manner substantially identical to that described above with respect to the transfer wheel 18*a*. The diameter of the end of the can body 2 is further reduced by the necking stations 16*c*, 16*d*, 16*e*, in a manner substantially identical to that noted above with respect to the necking station 16*a*.

The necking machine 12 further comprises a discharge module 21 located immediately downstream of the necking module 16*e*, and a discharge chute 22. The discharge module 21 comprises a discharge wheel 20 having a plurality of pockets 31 formed therein. The pockets 31 are adapted to receive the can body 2 from the necking module 16*e*. The can body 2 is retained in the pockets 31 in a manner substantially identical to that described above with respect to the input module 11 and the pockets 25.

The discharge wheel 20 rotates in a counterclockwise direction. The discharge wheel 20 carries the can body 2 through an arc of approximately 180 degrees, and deposits the can body 2 in the discharge chute 22. The discharge chute 22 subsequently guides the can body 2 out of the necking machine 12.

The input feed wheel 6, the transfer wheels 18*a*, 18*b*, 18*c*, 18*d*, and the discharge wheel 20 are each driven by a respective shaft 32 that, in turn, is driven by a corresponding gear 24 (see FIGS. 2 and 3). The necking stations 16*a*, 16*b*, 16*c*, 16*d*, 16*e* are each driven by a respective shaft 8 that, in turn, is driven by a corresponding gear 24 (see FIGS. 3 and 4C).

The gear 24 associated with the transfer module 19*c* is coupled to and driven by a motor 28 by way of a gear box 26 and a drive belt 30 (see FIG. 3, the motor 28, gear box 26, and drive belt 30 are not shown in FIG. 2, for clarity). The motor-driven gear 24 drives the two immediately adjacent gears 24, which, in turn, drive the next gears 24, and so on.

The drive shafts 32, 8 are each rotatably coupled to bearings 33 mounted on the bearing plate 9 (see FIG. 3). The necking stations 16*a*, 16*b*, 16*c*, 16*d*, 16*e* each support an end of their associated drive shaft 8 by way of a respective bearing housing 15 (see FIG. 4C). The transfer modules 19*a*, 19*b*, 19*c*, 19*d* each support an end of their associated drive shaft 32 by way of a respective bearing housing 13 (see FIG. 3).

Conventional fixed-base necking machines, in general, comprise no more than nine stages. Contemporary can necking operations, however, are often performed in more than nine stages. Ten or more necking stages are often needed to achieve the substantial reductions in diameter sought by many can manufacturers. Hence, two or more necking machines are often coupled in some manner to achieve the required number of necking stages for a particular application.

Multiple necking machines may be coupled using a conveyor that transports a partially necked can body from the first, or upstream, necking machine to the second, or downstream, necking machine. The second necking machine, upon receiving the can end, performs further necking operations thereon.

The use of a conveyor to couple upstream and downstream necking machines has several drawbacks. For example, conveyors may damage a can body during conveyance thereof, and can become jammed by the can bodies being conveyed thereon. Conveyors also require that the upstream and downstream necking machines be spaced apart to absorb can build-up caused by variations in speed between the upstream and downstream necking machines, thereby increasing the amount of floor space required by the necking machines.

Alternatively, multiple necking machines may be coupled using a transfer wheel, or bridge, similar to the transfer wheels 18*a*, 18*b*, 18*c*, 18*d*, positioned between the upstream and downstream necking machines. The transfer wheel receives a partially necked can body from the discharge module of the upstream necking machine, and transfers the can body to the input module of the downstream necking machine. The use of a transfer wheel in this manner is disclosed in U.S. Pat. No. 6,085,563.

The use of a transfer wheel to couple two or more necking machines has proven successful. The cost of procuring, installing, and operating this additional component, however, can be substantial. Moreover, the transfer wheel requires floor space in the manufacturing plant. This characteristic represents a disadvantage, as floor space in such plants is often limited.

Moreover, the can bodies can shift along their respective longitudinal axes within the pockets of the transfer wheel. Such shifting can cause the can bodies to be improperly positioned in the downstream necking module, thus leading to jamming of the necking module.

Consequently, a need exists for a method for coupling two or more necking machines without the use of a conveyor or a transfer wheel.

SUMMARY OF THE INVENTION

A preferred method is provided for closely coupling a first and a second necking machine each comprising a base, a bearing support plate fixedly coupled to the base, an input module comprising an input feed wheel adapted to receive a can body and a drive gear rotatably coupled to the bearing support plate, a necking module comprising a necking station adapted to reduce a diameter of an end of the can body and a drive gear rotatably coupled to the bearing support plate, and a discharge module comprising a discharge wheel adapted to discharge the can body from the necking machine and a drive gear rotatably coupled to the bearing support plate.

A preferred comprises removing the input module from the second necking machine, removing an end portion of the bearing support plate and an end portion of the base of the second necking machine, and fixing a cover plate to the base of the second necking machine.

A preferred method further comprises positioning the first and second necking machines end to end so that the drive gear of the discharge module of the first necking machine meshes with the drive gear of the necking module of the second necking machine and the necking module of the second necking machine is adapted to receive the can body from the discharge module of the first necking machine.

Another preferred method for closely coupling the first and second necking machines comprises removing the discharge module from the first necking machine, removing an end portion of the bearing support plate and an end portion of the base of the first necking machine, and fixing a cover plate to the base of the first necking machine.

A preferred method also comprises positioning the first and second necking machines end to end so that the drive gear of the necking module of the first necking machine meshes with the drive gear of the input module of the second necking machine and the input module of the second necking machine is adapted to receive the can body from the necking module of the first necking machine.

Another preferred method is provided for closely coupling a first and a second necking machine each comprising a base, a bearing support plate fixedly coupled to the base, an input module adapted to carry a can body in a downstream direction and comprising a drive gear rotatably coupled to the bearing support plate, a necking module located downstream of the input module, adapted to reduce a diameter of an end of the can body, and comprising a drive gear rotatably coupled to the bearing support plate, and a discharge module located downstream of the necking module, adapted to discharge the can body in the downstream direction, and comprising a drive gear rotatably coupled to the bearing support plate.

A preferred method comprises removing the input module from the second necking machine, removing a portion of the bearing support plate and a portion of the base of the second necking machine located upstream of the of the necking module of the second necking machine, and fixing a cover plate to the base of the second necking machine.

A preferred method also comprises positioning an upstream end of the second necking machine adjacent a downstream end of the first necking machine so that the drive gear of the discharge module of the first necking machine meshes with the drive gear of the necking module of the second necking machine and the necking module of the second necking machine is adapted to receive the can body from the discharge module of the first necking machine.

Another preferred method for closely coupling the first and second necking machine comprises removing the discharge module from the first necking machine, removing a portion of the bearing support plate and a portion of the base of the first necking machine located downstream of the of the necking module of the first necking machine, and fixing a cover plate to the base of the first necking machine.

A preferred method also comprises positioning an upstream end of the second necking machine adjacent a downstream end of the first necking machine so that the drive gear of the necking module of the first necking machine meshes with the drive gear of the input module of the second necking machine and the input module of the second necking machine is adapted to receive the can body from the necking module of the first necking machine.

BRIEF DESCRIPTION OF THE DRAWINGS

The foregoing summary, as well as the following detailed description of a presently-preferred method, is better understood when read in conjunction with the appended drawings. For the purpose of illustrating the invention, the drawings show an embodiment that is presently preferred. The invention is not limited, however, to the specific instrumentalities disclosed in the drawings. In the drawings.

DESCRIPTION OF PREFERRED METHODS

Figure 1:
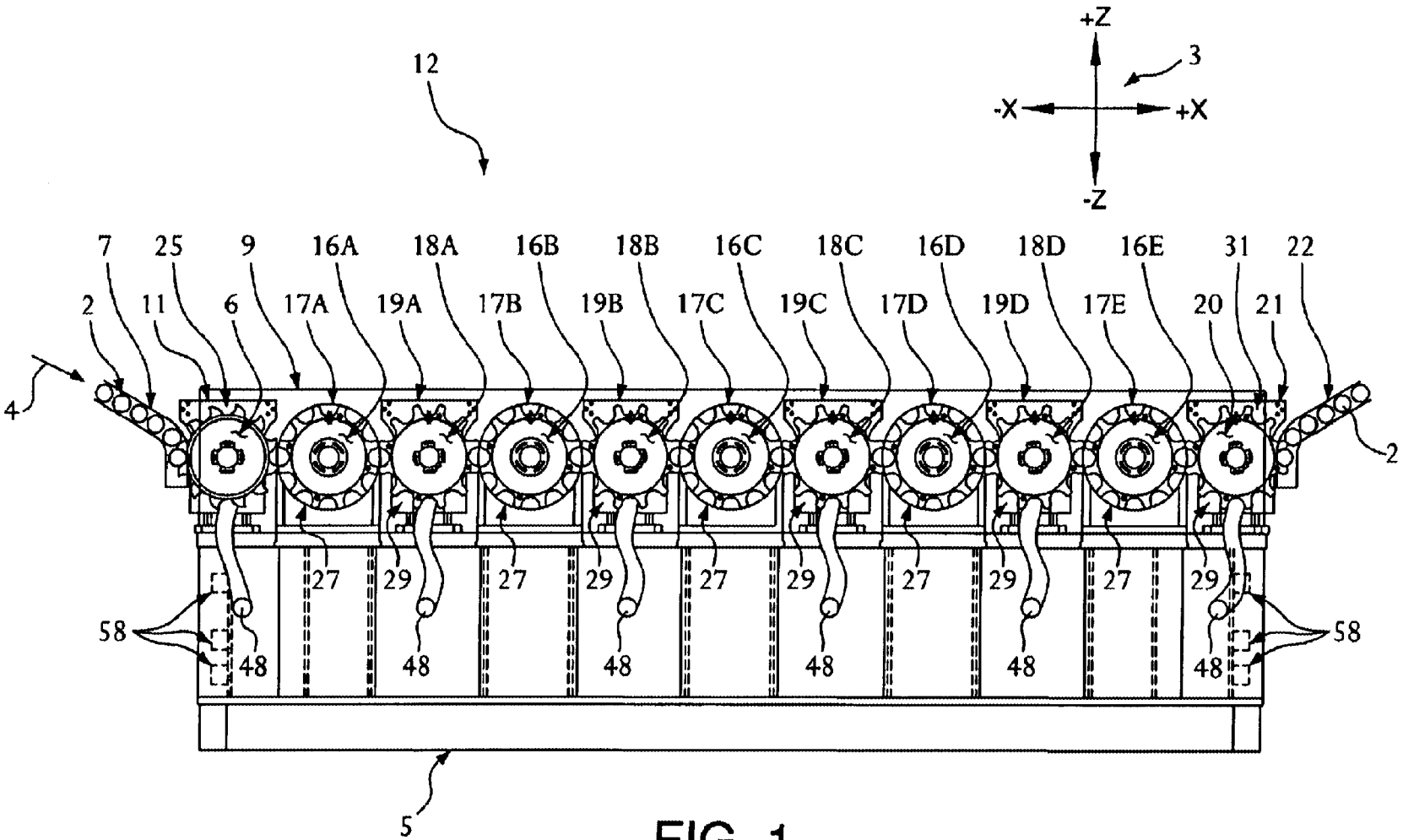
FIG. 1 is a front view of a five-stage necking machine capable of being closely coupled to another necking module in accordance with the presently-preferred embodiment.
Figure 2:
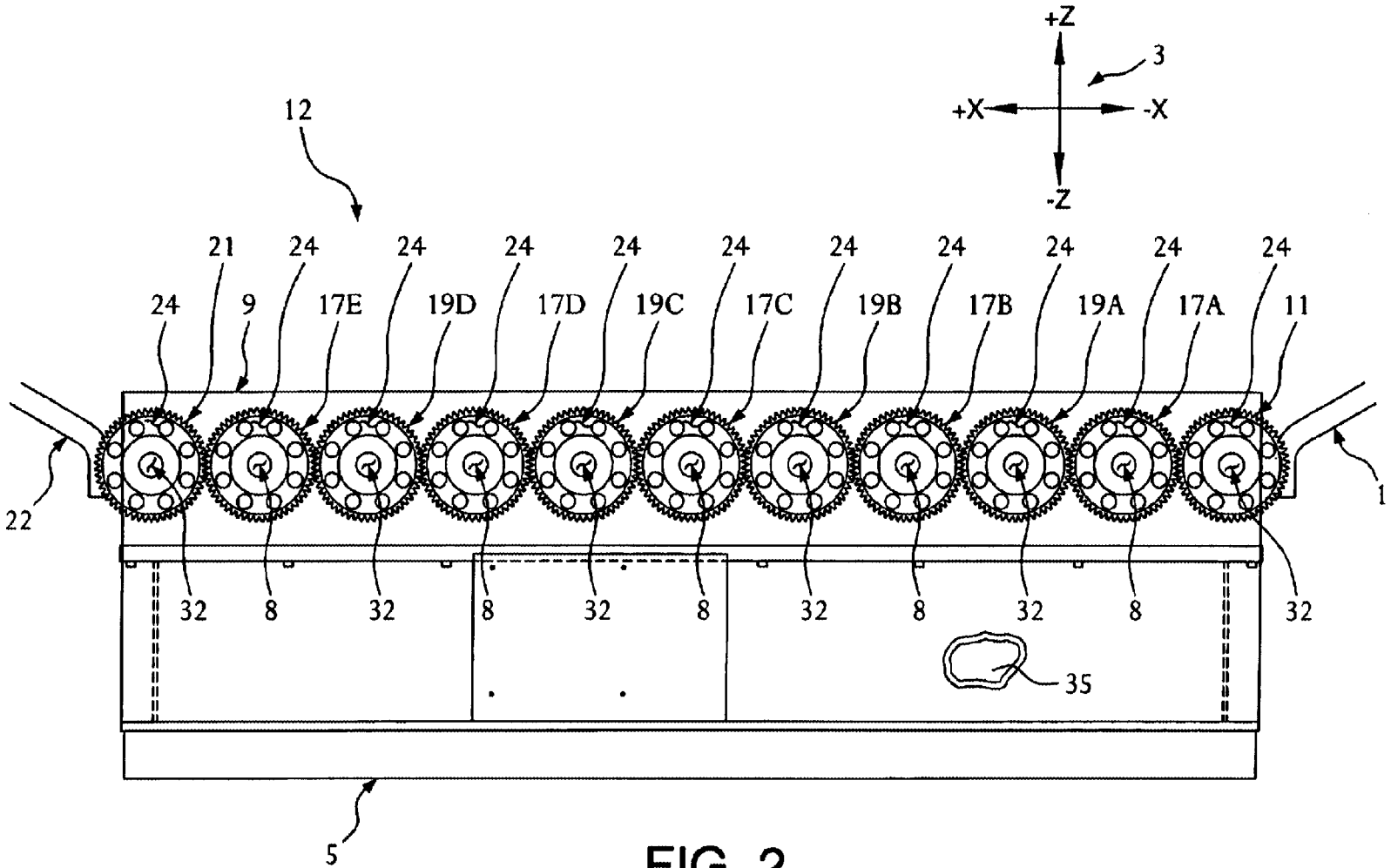
FIG. 2 is a rear view of the necking machine shown in FIG. 1, with a motor, gear box, and drive belt of the necking machine not depicted, for clarity.
Figure 3:
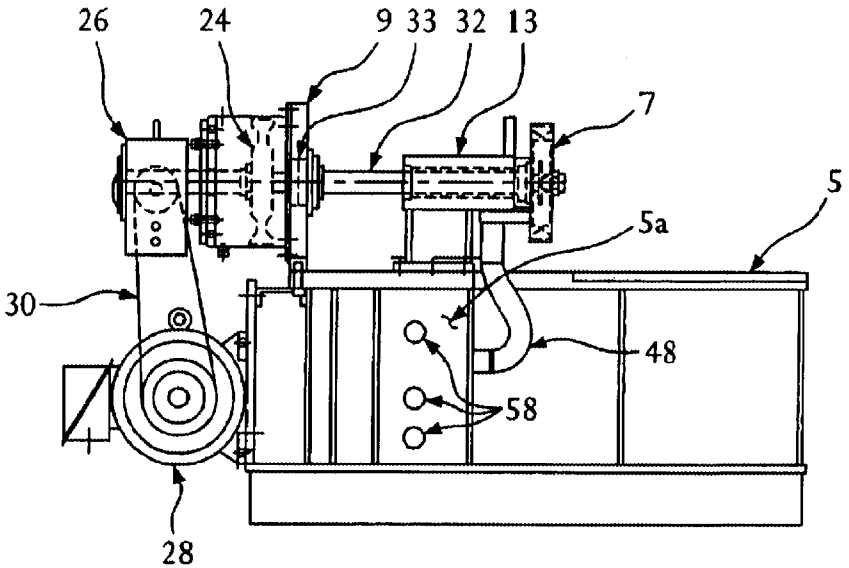
FIG. 3 is a side view of the necking machine shown in FIGS. 1 and 2.

A presently-preferred method for closely coupling two or more necking machines is described herein in connection with a first five-stage necking machine 12' and a second five-stage necking machine 12". The necking machines 12', 12" are described for exemplary purposes only, as the presently-preferred method can be used in connection with other types of necking machines, including necking machine having more or less than five stages.

The first and second necking machines 12', 12", before being modified as set forth below, are substantially identical to the previously described necking machine 12. The above description of the necking machine 12 therefore applies equally to the first and second necking machines 12', 12". Corresponding components of the necking machines 12, 12', 12" are denoted herein by identical reference numerals; reference numerals denoting components of the first and second necking machines 12', 12" are followed by a prime (') and a double prime (") marking, respectively.

The first and second necking machines 12', 12" are closely coupled in accordance with the presently-preferred method, as follows. A preferred method comprises modifying the second necking machine 12" by removing the input chute 7" and the input feed module 11". The second necking machine 12" is also modified by removing the motor 28", gear box 26", and drive belt 30".

Figure 6B:
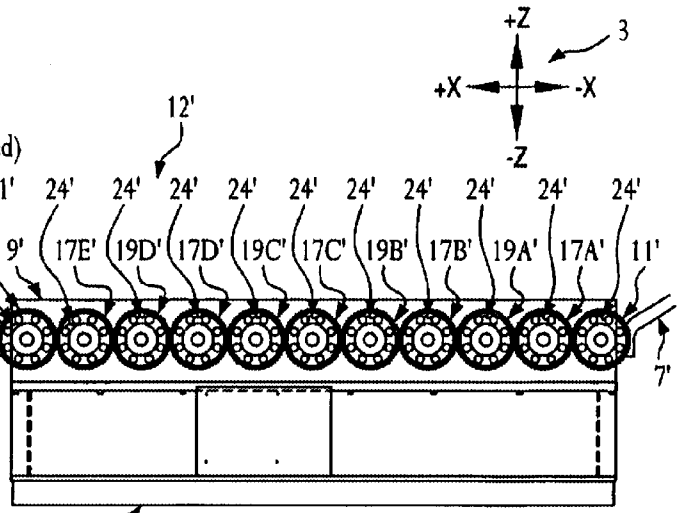
FIG. 6B is a rear view of the first necking machine configured as shown in FIGS. 4A and 5.
Figure 6A:
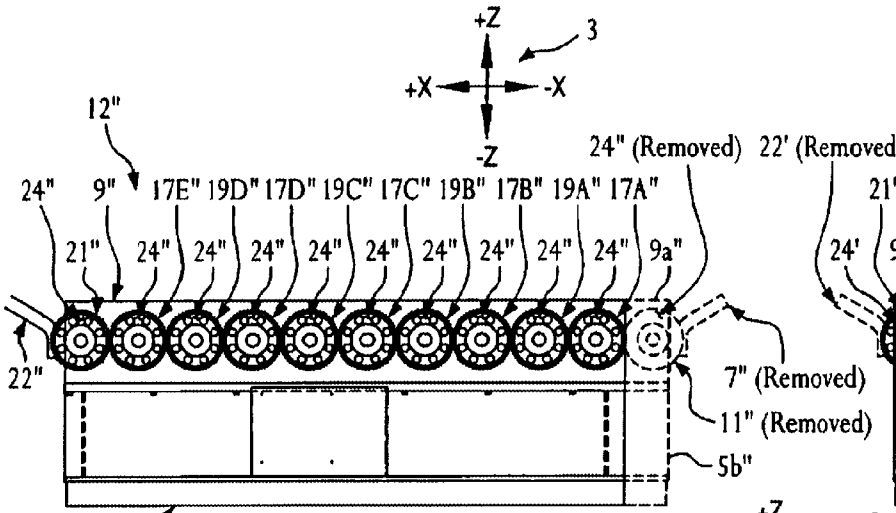
FIG. 6A is a rear view of the second necking machine configured as shown in FIGS. 4B and 5.

The second necking machine 12" is further modified by removing an end portion 5*b*" of the base 5" and an end portion 9*a*" of the bearing plate 9" from the necking machine 12", as follows (the end portions 9*a*", 5*b*" are depicted in phantom in FIGS. 4B and 6A).

The end plate 5*a*" of the base 5" is initially cut in a substantially rectangular pattern around the pipes 58". Moreover, two small welds are made at the mating surfaces of the base 5" and the bearing plate 9". The welds are preferably located downstream of, and proximate to the input feed module 11". (The "downstream" and "upstream" directions correspond respectively to the "+x" and "−x" directions denoted on the coordinate system 3 included in the figures). The purpose of the noted welds is explained below.

The base 5" and the bearing plate 9" are subsequently cut along their respective perimeters, at a longitudinal ("x" axis) position denoted by the line 53 in FIG. 4B. The line 53 coincides with the forward most, i.e., upstream, edge of the necking station 16*a*". A cutting torch may be used to cut the base 5" and the bearing plate 9". Alternative cutting means such as milling can also be used.

Figure 4C:
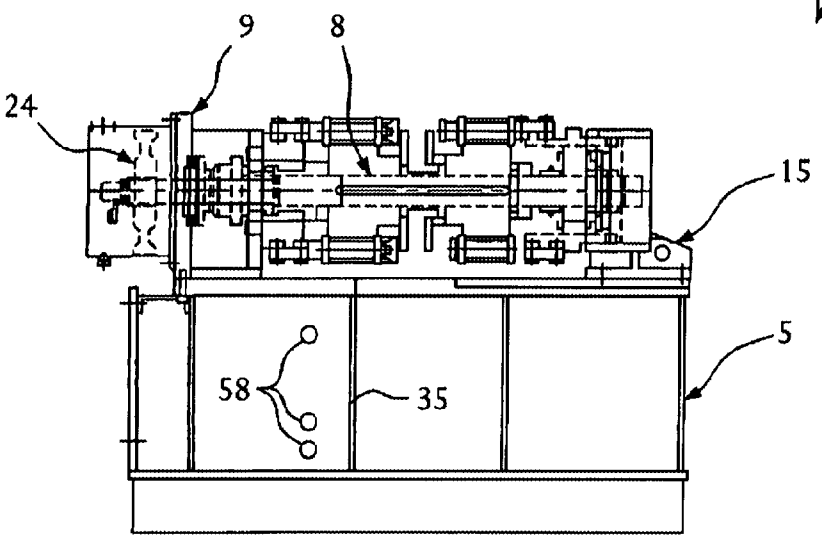
FIG. 4C is an end view of the second necking machine shown in FIG. 4B after and end portion thereof has been removed and before a replacement end plate has been affixed thereto.

The end portions 5*b*", 9*a*" of the base 5" and the bearing plate 9", i.e., the portions of the base 5" and the bearing plate 9" upstream of the line 53, are physically separated and removed from the second necking machine 12" once the above-noted cuts have been made. This action exposes the internal volume 35 of the second necking machine 12" (see FIG. 4C, which depicts the second necking machine 12" immediately after the end portions 5*b*", 9*a*" have been removed).

The end portions 5*b*", 9*a*" of the base 5" and the bearing plate 9" are each adapted to receive a dowel pin that precisely locates the base 5" and the bearing plate 9" in relation to each other. The above-noted welds made at the mating surfaces of the base 5" and the bearing plate 9" keep the base 5" and the bearing plate 9" in the proper relative positions once the end portions 5*b*", 9*a*" have been removed.

The rectangular cut made on the end plate 5*a*" proximate the pipes 58 permits the end portion 5*b*" of the base 5" to be removed without damaging or otherwise disturbing the pipes 58".

The pipes 58" are subsequently cut so that the ends thereof lie substantially flush with the newly-formed forward (upstream) end of the second necking machine 12". This operation removes the rectangular portion of the end plate 5*a*" that remained with the pipes 58" as the end portion 5*b*" of the base 5" was separated from the necking machine 12".

An end plate 52 is subsequently fixed to the newly-formed forward end of the base 5" (see FIG. 4B, the end plate 52 is depicted in both its installed position on the base 5", and in an uninstalled position with arrows 51 indicating the direction in which the end plate 52 is installed).

The end plate 52 has a shape that is substantially similar to that of the plate 5*a*", and has through holes formed therein for accommodating the pipes 58". The end plate 52 covers and seals the inner volume 35 the base 5", which was exposed by the removal of the end portion 5*b*" (and the plate 5*a*"). (The end plate 52 thus functions as a "new" or "replacement" end plate for the base 5".) The end plate 52 is recessed into the end of base 5", in a manner substantially similar to the plate 5*a*" prior to its removal (see FIG. 4B). The second necking machine 12" at this point is configured as shown in FIGS. 4B and 6A, and is ready to be coupled to the first necking machine 12'.

The presently-preferred method further comprises removing the discharge chute 22' from the first necking machine 12', thereby exposing the discharge wheel 20' of the first necking machine 12'. The first necking machine 12' at this point is configured as shown in FIGS. 4A and 6B, and is ready to be coupled to the second necking machine 12".

Figure 7:
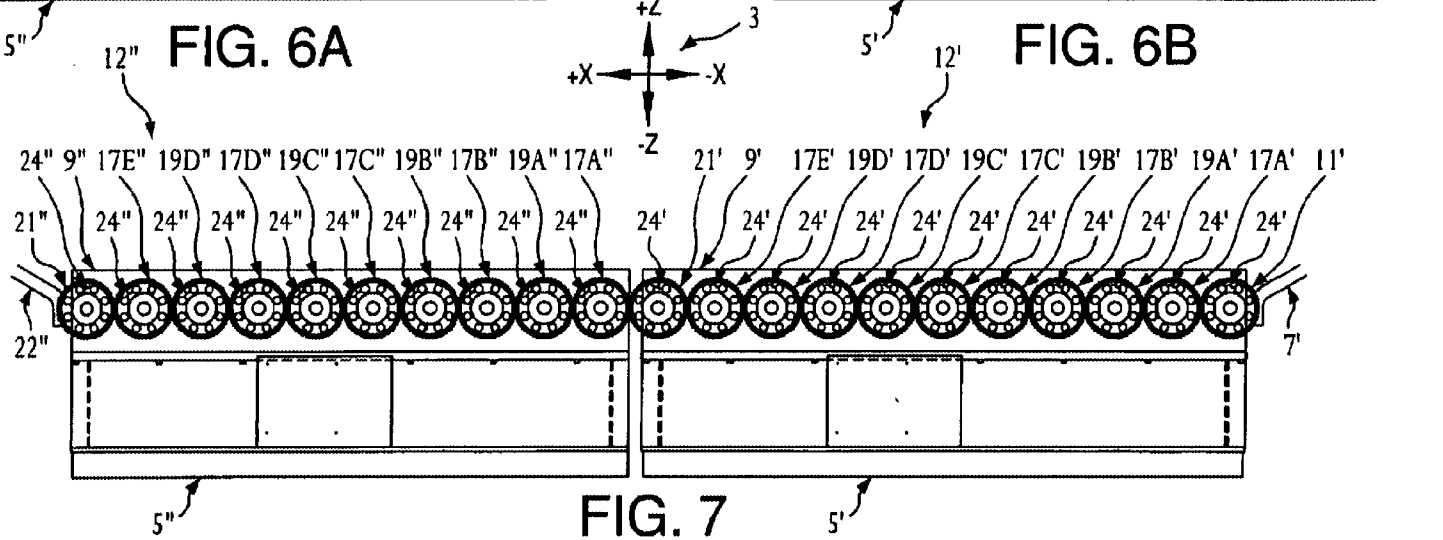
FIG. 7 is a rear view of the first necking machine coupled to the second necking machine as shown in FIG. 5.

The necking machines 12', 12" are subsequently coupled as follows. The necking machines 12', 12" are placed end to end as depicted in FIGS. 5 and 7. In other words, the downstream end of the first necking machine 12' is substantially butted against the upstream end of the second necking machine 12" so that the drive gear 24' of the discharge module 21 ' on the first necking machine 12' meshes with the drive gear 24" of the first necking module 17*a*" on the second necking machine 12" (see FIG. 7).

A jackscrew (not shown) can be used to pull the first and second necking machines 12', 12" together in a precise manner. The jackscrew can also be used to hold the first and second necking machines 12', 12" in position thereafter. It should be noted, however, that an attachment means such as a jackscrew is not necessary, especially in situations where relatively large necking machines are being coupled.

The uppermost of the pipes 58', 58" of the respective first and second necking machines 12', 12" is preferably capped at the end that faces the other necking machine 12', 12". Each of the first and second necking machines 12', 12" is thus provided with vacuum on an individual basis, i.e., vacuum is not transferred from one of the necking machines 12', 12" to the other.

The two lowermost pipes 59', 58" are preferably coupled by way of a flexible hose (not shown) so that positive or pressurized air can be transferred between the first and second necking machines 12', 12". Hence, positive or pressurized air can be provided to the necking machines 12', 12" using a single supply line. Alternatively, the two lowermost pipes 58', 58" can be capped so that each necking machine 12', 12" is provided with positive or pressurized air on an individual basis.

Other services such as electricity can be supplied to each necking machine 12', 12" on an individual basis, using the lines, ports, etc. originally provided for those services. Alternatively, the services can be supplied to the necking machines 12', 12" as a single unit.

Positioning the necking machines 12', 12" in the above-noted manner causes the drive gear 24' of the discharge module 21 ' on the first necking machine 12' to mesh with the drive gear 24" of the first necking module 17*a*" of the second necking machine 12", as noted above. The drive gear 24' of the discharge module 21', which is actuated by the motor 28', gear box 26', and drive belt 30' of the first necking machine 12', directly drives the drive gear 24" of the first necking module 17*a*". (The drive gear 24' of the discharge module 21' thus indirectly drives the remaining drive gears 24" of the second necking module 12").

Figures 4A, 4B, 5:
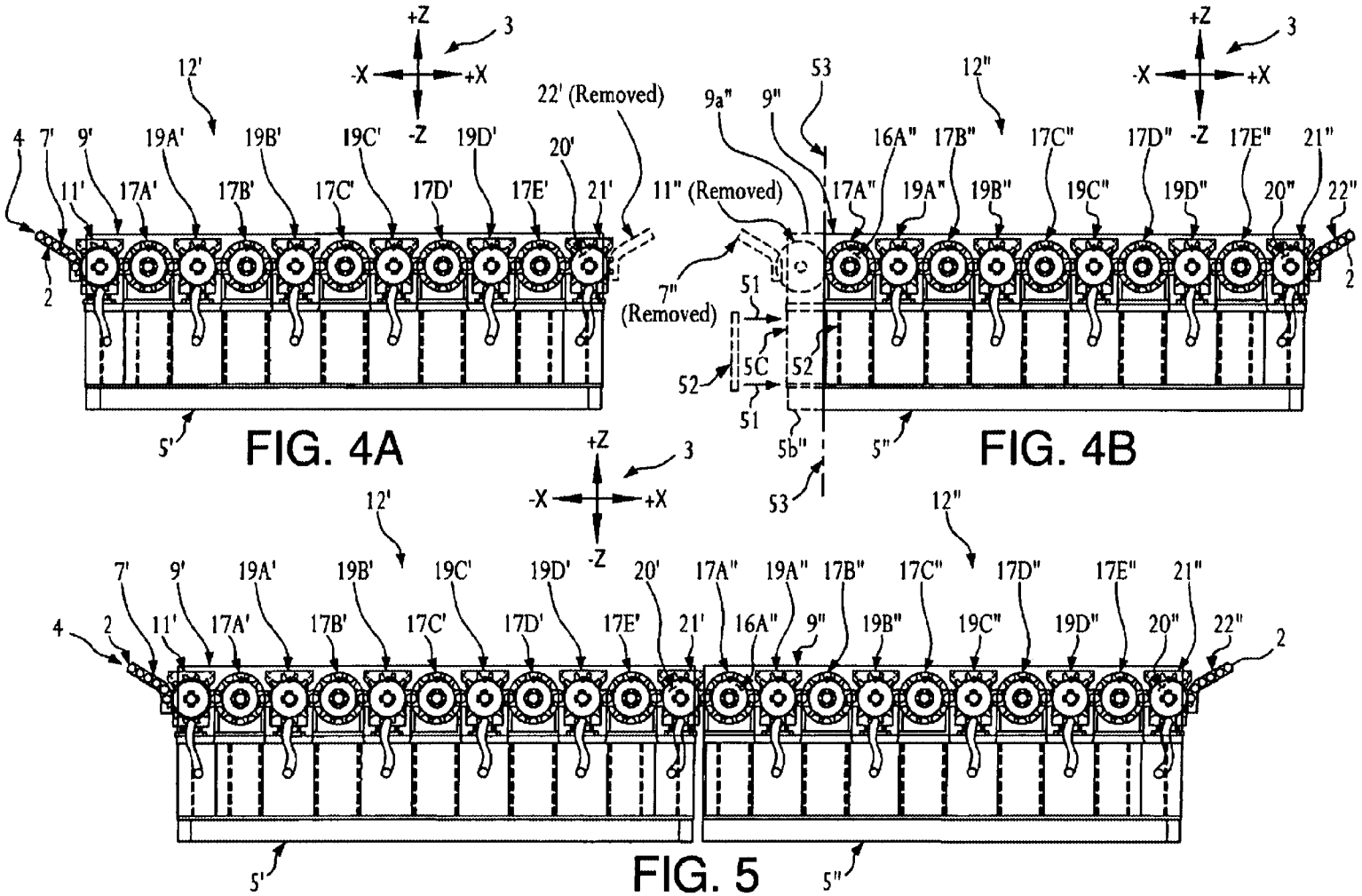
FIG. 4A is a front view of a first necking machine substantially identical to the necking machine shown in FIGS. 1–3, configured to be closely coupled to another necking machine, with a motor, gear box, and drive belt of the second necking machine not depicted, for clarity.
FIG. 4B is a front view of a second necking machine substantially identical to the necking machine shown in FIGS. 1–3, configured to be closely coupled to the first necking machine shown in FIG. 4A.
FIG. 5 is a front view of the first necking machine shown in FIG. 4A closely coupled to the second necking machine shown in FIGS. 4B, 4C.

Positioning the necking machines 12', 12" in the above-noted manner places the necking station 16*a*" of the second necking machine 12" directly downstream of the discharge wheel 20' of the first necking machine 12' (see FIG. 5).

The drive gear 24' of the discharge module 21' and the drive gear 24" of the necking station 16*a*" are indexed before being meshed so that the discharge wheel 20" is in time with necking station 16*a*". Hence, the necking station 16*a*" of the second necking machine 12" is adapted to receive partially-necked can bodies 2 from the discharge wheel 20' of the first necking machine 12' once the necking machines 12', 12" have been placed end to end as noted.

The closely-coupled necking machines 12', 12" function as a single, ten-stage necking machine. More particularly, the can body 2 undergoes five incremental necking operations while passing through the necking modules 16*a*', 16*b*', 16*c*', 16*d*', 16*e*' of the first necking machine 12'.

The discharge wheel 20' of the first necking machine 12' transfers the partially necked can body 2 from the necking station 16*e*' of the first necking machine 12', to the necking station 16*a*" of the second necking machine 12". Hence, the discharge wheel 20' functions as a transfer wheel when the first and second necking machines 12', 12" are coupled as noted.

The can body 2 subsequently undergoes five additional incremental necking operations while passing through the necking modules 16*a*", 16*b*", 16*c*", 16*d*", 16*e*" of the second necking machine 12". The fully necked can body subsequently passes out of the necking machine 12" by way of the discharge module 21 " and the discharge chute 22".

The presently-preferred method permits the first and second necking machines 12', 12" to be closely coupled in a simple and cost-effective manner. For example, the necking machines 12', 12" can be coupled without the need for additional equipment, e.g., a transfer wheel or conveyor, to carry the can bodies 2 between the first and second necking machines 12', 12". This function, as explained above, is performed by the discharge wheel 20' of the first necking machine 12'. In other words, the interface between the first and second necking machines 12', 12" is provided by one of the original components of the first necking machine 12'. Hence, the substantial expense, space, and time associated with procuring, installing, and operating an additional major component are not incurred when the first and second necking machines 12', 12" are coupled in accordance with the presently-preferred method.

Moreover, the modifications needed to couple the necking machines 12', 12" can be performed with minimal time and effort, and without expensive or scarce machinery.

The presently-preferred method thus facilitates coupling two or more necking machines in a relatively inexpensive, quick, and space-efficient manner. Hence, two or more necking machines each having a low number of stages can readily be converted into a single integrated unit comprising a relatively large number of stages.

It is to be understood that even though numerous characteristics and advantages of the present invention have been set forth in the foregoing description, the disclosure is illustrative only and changes may be made in detail within the principles of the invention to the full extent indicated by the broad general meaning of the terms in which the appended claims are expressed.

For example, the necking machines 12', 12" may be closely coupled in accordance with the following method. The discharge chute 22' and the discharge module 21' are removed from the first necking machine 12', and the input chute 7" is removed from the second necking machine 12".

The base 5' and the bearing support plate 9' of the first necking machine are cut along a line corresponding substantially to the rearward most edge of the necking station **16*e*'. A rearward portion of the base 5' and the bearing support plate 9', i.e., the portions of the base 5' and the bearing support plate 9' downstream of the cut, are then removed. The pipes 58' are cut so as to lie substantially flush with the newly-formed rearward edge of the base 5'. A plate is fixed to the rearward edge of the base 5' to seal the exposed interior volume 35' of the first necking machine 12'**.

The necking machines 12', 12" are subsequently placed end to end so that the drive gear 24' of the necking module **17*e*' on the first necking machine 12' meshes with the drive gear 24' of the input module 11" on the second necking machine 12". This arrangement permits the feed wheel 6" of the second necking machine 12" to function as a transfer wheel that transfers the partially-necked can body 2 from the necking station 16*e*' of the first necking machine 12', to the necking station 16*a*" of the second necking machine 12"**.

Furthermore, the motor 28', gear box 26', and drive belt 30' of the first necking machine 12' can be removed in lieu of removing the motor 28", gear box 26", and drive belt 30" of the second necking machine 12" in either of the above-described methods. (The drive gears 24' of the first necking machine 12' are thus driven by the motor 28", gear box 26", and drive belt 30" of the second necking machine 12" in this particular variant.)

In addition, regardless of whether the noted drive components are removed from the first or the second necking machine 12', 12", the remaining drive components, i.e., the motor 28', gear box 26', and drive belt 30', or the motor 28", gear box 26", and drive belt 30", can be modified to withstand the increased loading placed thereon as a result of the removal of the other set of drive components.

Moreover, the presently-preferred method is not limited to use with two necking machines. In other words, three or more necking machines can be closely coupled using the presently-preferred method. For example, a downstream end of a first necking machine can be closely coupled to an upstream end of a second necking machine in accordance with any of the above-described methods. A downstream end of the second necking machine can likewise be closely coupled to an upstream end of a third necking machine in accordance with any the above-described method, and so on.

What is claimed is:

1. A method for closely coupling a first and a second necking machine each comprising (i) a base, (ii) a bearing support plate fixedly coupled to the base, (iii) an input module comprising an input feed wheel adapted to receive a can body and a drive gear rotatably coupled to the bearing support plate, (iv) a necking module comprising a necking station adapted to reduce a diameter of an end of the can body and a drive gear rotatably coupled to the bearing support plate, and (v) a discharge module comprising a discharge wheel adapted to discharge the can body from the necking machine and a drive gear rotatably coupled to the bearing support plate, the method comprising:

removing the input module from the second necking machine;

removing an end portion of the bearing support plate and an end portion of the base of the second necking machine;

fixing a cover plate to the base of the second necking machine; and positioning the first and second necking machines end to end so that the drive gear of the discharge module of the first necking machine meshes with the drive gear of the necking module of the second necking machine and the necking module of the second necking machine is adapted to receive the can body from the discharge module of the first necking machine.

2. The method of claim 1, wherein removing an end portion of the bearing support plate and an end portion of the base of the second necking machine comprises cutting the bearing support plate and the base of the second necking machine at a longitudinal position coinciding substantially with a forward edge of the necking station of the second necking machine.

3. The method of claim 1, wherein removing an end portion of the bearing support plate and an end portion of the base of the second necking machine comprises removing a portion of the bearing support structure and a portion of the base of the second necking machine located forward of the necking station of the second necking machine.

4. The method of claim 1, wherein removing an end portion of the bearing support plate and an end portion of the base of the second necking machine comprises cutting the bearing support plate and the base of the second necking machine with a cutting torch.

5. The method of claim 1, wherein fixing a cover plate to the base of the second necking machine comprises fixing a cover plate to an end of the base of the second necking machine formed by removing the end portion of the base of the second necking machine.

6. The method of claim 1, wherein removing an end portion of the bearing support plate and an end portion of the base of the second necking machine comprises cutting an end plate of the base of the second necking machine around a pipe extending through the end plate.

7. The method of claim 6, further comprising cutting the pipe so that an end of the pipe lies substantially flush with the end of the base of the second necking machine.

8. The method of claim 1, further comprising indexing the drive gears of the discharge module of the first necking machine and the necking station of the second necking machine before positioning the first and second necking machines end to end so that the discharge wheel of the first necking machine is in registration with the necking station of the second necking machine.

9. The method of claim 1, further comprising removing an input chute of the second necking machine and removing a discharge chute of the first necking machine.

10. The method of claim 1, wherein removing an end portion of the bearing support plate and an end portion of the base of the second necking machine comprises cutting the base of the second necking machine along a perimeter of the base of the second necking machine.

11. The method of claim 1, wherein removing the input module from the second necking machine comprises physically separating the input module of the second necking machine from a remainder of the second necking machine.

12. The method of claim 1, wherein removing an end portion of the bearing support plate and an end portion of the base of the second necking machine comprises physically separating the end portion of the bearing support plate and the end portion of the base of the second necking machine from a remainder of the second necking machine.

13. The method of claim 1, wherein fixing a cover plate to the base of the second necking machine comprises covering an internal volume of the base of the second necking machine exposed by removing the end portion of the base of the second necking machine.

14. The method of claim 1, further comprising removing a motor, a drive belt, and a gearbox from at least one of the first and second necking machines.

15. The method of claim 1, further comprising welding the bearing support plate of the second necking machine to the base of the second necking machine prior to removing the end portion of the bearing support plate and the end portion of the base of the second necking machine.

16. A method for closely coupling a first and a second necking machine each comprising (i) a base, (ii) a bearing support plate fixedly coupled to the base, (iii) an input module comprising an input feed wheel adapted to receive a can body and a drive gear rotatably coupled to the bearing support plate, (iv) a necking module comprising a necking station adapted to reduce a diameter of an end of the can body and a drive gear rotatably coupled to the bearing support plate, and (v) a discharge module comprising a discharge wheel adapted to discharge the can body from the necking machine and a drive gear rotatably coupled to the bearing support plate, the method comprising:

removing the discharge module from the first necking machine;

removing an end portion of the bearing support plate and an end portion of the base of the first necking machine;

fixing a cover plate to the base of the first necking machine; and positioning the first and second necking machines end to end so that the drive gear of the necking module of the first necking machine meshes with the drive gear of the input module of the second necking machine and the input module of the second necking machine is adapted to receive the can body from the necking module of the first necking machine.

17. The method of claim 16, wherein removing an end portion of the bearing support plate and an end portion of the base of the first necking machine comprises cutting the bearing support plate and the base of the first necking machine at a longitudinal position coinciding substantially with a rearward edge of the necking station of the first necking machine.

18. The method of claim 16, wherein removing an end portion of the bearing support plate and an end portion of the base of the first necking machine comprises removing a portion of the bearing support structure and a portion of the base of the first necking machine located rearward of the necking station of the first necking machine.

19. The method of claim 16, wherein removing an end portion of the bearing support plate and an end portion of the base of the first necking machine comprises cutting the bearing support plate and the base of the first necking machine with a cutting torch.

20. The method of claim 16, wherein fixing a cover plate to the base of the first necking machine comprises fixing a cover plate to an end of the base of the first necking machine formed by removing the end portion of the base of the first necking machine.

21. The method of claim 16, wherein removing an end portion of the bearing support plate and an end portion of the base of the first necking machine comprises cutting an end plate of the base of the first necking machine around a pipe extending through the end plate.

22. The method of claim 21, further comprising cutting the pipe so that an end of the pipe lies substantially flush with the end of the base of the first necking machine.

23. The method of claim 16, further comprising indexing the drive gears of the input module of the second necking machine and the necking station of the first necking machine before positioning the first and second necking machines end to end so that the input wheel of the second necking machine is in registration with the necking station of the first necking machine.

24. The method of claim 16, further comprising removing an input chute of the second necking machine and removing a discharge chute of the first necking machine.

25. The method of claim 16, wherein removing an end portion of the bearing support plate and an end portion of the base of the first necking machine comprises cutting the base of the first necking machine along a perimeter of the base of the first necking machine.

26. The method of claim 16, wherein removing the discharge module from the first necking machine comprises physically separating the discharge module of the first necking machine from a remainder of the first necking machine.

27. The method of claim 16, wherein removing an end portion of the bearing support plate and an end portion of the base of the first necking machine comprises physically separating the end portion of the bearing support plate and the end portion of the base of the first necking machine from a remainder of the first necking machine.

28. The method of claim 16, wherein fixing a cover plate to the base of the first necking machine comprises covering an internal volume of the base of the first necking machine exposed by removing the end portion of the base of the first necking machine.

29. The method of claim 16, further comprising removing a motor, a drive belt, and a gearbox from at least one of the first and second necking machines.

30. The method of claim 1, further comprising welding the bearing support plate of the first necking machine to the base of the first necking machine prior to removing the end portion of the bearing support plate and the end portion of the base of the first necking machine.

31. A method for closely coupling a first and a second necking machine each comprising (i) a base, (ii) a bearing support plate fixedly coupled to the base, (iii) an input module adapted to carry a can body in a downstream direction and comprising a drive gear rotatably coupled to the bearing support plate, (iv) a necking module located downstream of the input module and adapted to reduce a diameter of an end of the can body, the necking module comprising a drive gear rotatably coupled to the bearing support plate, and (v) a discharge module located downstream of the necking module and adapted to discharge the can body in the downstream direction, the discharge module comprising a drive gear rotatably coupled to the bearing support plate, the method comprising:

removing the input module from the second necking machine;

removing a portion of the bearing support plate and a portion of the base of the second necking machine located upstream of the of the necking module of the second necking machine;

fixing a cover plate to the base of the second necking machine; and positioning an upstream end of the second necking machine adjacent a downstream end of the first necking machine so that the drive gear of the discharge module of the first necking machine meshes with the drive gear of the necking module of the second necking machine and the necking module of the second necking machine is adapted to receive the can body from the discharge module of the first necking machine.

32. The method of claim 31, wherein fixing a cover plate to the base of the second necking machine comprises fixing the cover plate to an upstream end of the base of the second necking machine.

33. A method for closely coupling a first and a second necking machine each comprising (i) a base, (ii) a bearing support plate fixedly coupled to the base, (iii) an input module adapted to carry a can body in a downstream direction and comprising a drive gear rotatably coupled to the bearing support plate, (iv) a necking module located downstream of the input module and adapted to reduce a diameter of an end of the can body, the necking module comprising a drive gear rotatably coupled to the bearing support plate, and (v) a discharge module located downstream of the necking module and adapted to discharge the can body in the downstream direction, the discharge module comprising a drive gear rotatably coupled to the bearing support plate, the method comprising:

removing the discharge module from the first necking machine;

removing a portion of the bearing support plate and a portion of the base of the first necking machine located downstream of the of the necking module of the first necking machine;

fixing a cover plate to the base of the first necking machine; and positioning an upstream end of the second necking machine adjacent a downstream end of the first necking machine so that the drive gear of the necking module of the first necking machine meshes with the drive gear of the input module of the second necking machine and the input module of the second necking machine is adapted to receive the can body from the necking module of the first necking machine.

34. The method of claim 33, wherein fixing a cover plate to the base of the first necking machine comprises fixing the cover plate to a downstream end of the base of the first necking machine.

* * * * *